United States Patent [19]

DeCaro

[11] 4,018,254

[45] Apr. 19, 1977

[54] INSTALLATION TOOL APPARATUS

[75] Inventor: Charles J. DeCaro, Marshfield, Mass.

[73] Assignee: Textron, Inc., Providence, R.I.

[22] Filed: Nov. 17, 1975

[21] Appl. No.: 632,676

[52] U.S. Cl. ..... 144/32 R; 227/136

[51] Int. Cl.[2] ..... B25B 23/10

[58] Field of Search ..... 144/32; 145/52; 227/136

[56] References Cited

UNITED STATES PATENTS

| | | | |
|---|---|---|---|
| 1,499,887 | 7/1924 | Snyder et al. | 144/32 |
| 2,009,580 | 7/1935 | Govanus | 227/136 |
| 2,706,506 | 4/1955 | Wagner | 145/52 |
| 2,840,126 | 6/1958 | Schmitt | 144/32 |
| 3,601,168 | 8/1971 | Fernstrom | 144/32 |

*Primary Examiner*—Donald R. Schran

*Attorney, Agent, or Firm*—Webb, Burden, Robinson & Webb

[57] ABSTRACT

The barrel assembly for attachment to a standard driving tool includes a sleeve adapted for attachment to the tool, a barrel retractably mounted in the sleeve and a bushing positioned within the sleeve and extending into a barrel bore. The barrel includes aligned entry and exit trackways to accommodate a strip containing fasteners and the bushing is adapted to position the fastener within the bore of the barrel in a first position and then in a second position engage the strip so as to clamp it in place as the driver disengages the fastener therefrom. A carriage assembly can be positioned within the end of the barrel so as to form an internal restrictive bore for the fastener in a first position and an enlarged bore in a second position so as to permit the fastener to pass therethrough.

12 Claims, 8 Drawing Figures

INSTALLATION TOOL APPARATUS

FIELD OF THE INVENTION

This invention relates to a driving tool for a fastener and, more particularly, to a barrel assembly for receiving fasteners retained on a plastic strip and which enables the fasteners to be disengaged from the strip and held in proper alignment for driving.

DESCRIPTION OF THE PRIOR ART

In my U.S. Pat. No. 3,920,169, issued Nov. 18, 1975, I disclosed a feed mechanism and a barrel assembly for feeding a replaceable strip of fasteners into and through the barrel assembly and a clamping means for separating the fasteners from the strip upon impact by the driver of the driving tool. The clamping means for separating the fastener from the strip comprised a floating bushing positioned at the bottom end of the barrel and which upon contact with the workpiece retracted upward into the barrel to engage the strip prior to removal of the fastener therefrom by the driver. While this concept has proven successful, it does present one drawback, namely, the bushing is in a rather vulnerable location. The bushing engages the workpiece prior to every impact and the bushing is exposed to damage from the fastener should the fastener be out of alignment and thereby driven against the bushing rather than through the bushing bore. The bushing is, therefore, subjected to rough operating conditions because of its vulnerable positioning at the end of the barrel.

In my U.S. Pat. No. 3,973,605, issued Aug. 10, 1976, I further disclosed another barrel assembly in which guide fingers extended through the barrel wall near the end thereof so as to align fasteners within the barrel bore and thereby permit rapid and accurate installation of the fasteners. While this invention has also proven satisfactory for most applications, certain fastener installations present demanding torquing conditions so that the fastener must be firmly held during its initial entry into the workpiece. Such a fastener is the self-drilling and tapping screw in which the fastener actually drills its own hole in sheet metal before the tapping threads begin to engage the workpiece. Because of the high torque requirements of the drilling operation, the fastener tends to skid or walk along the workpiece before penetrating and this causes the fastener to be set out of position and may also cause a marred workpiece surface. This latter condition is totally unacceptable in many applications such as exposed metal siding, etc.

SUMMARY OF THE INVENTION

I have now improved upon the concepts disclosed in my earlier identified applications and I have combined those improvements into a single barrel assembly, although either improvement can be utilized independent of the other.

Specifically, I have removed the bushing from the end of the barrel where it was subjected to wear and abuse without sacrificing the function it performed. I have positioned and further designed the bushing so it can act as a locater for the fasteners coming into the barrel bore as well as a clamping device during disengagement of the fastener from the strip. I have also modified the guide fingers of my earlier application so that they will function in a first position as a rigid internal guide bore and thereafter pivot out of the way so that a fastener can pass therethrough.

My barrel assembly includes a sleeve connectable to the driving tool. A barrel is connected and retractable within the sleeve and a bushing is positioned within the sleeve so as to extend into the barrel. An aligned entry and exit trackway extends through a wall of the barrel to accommodate the strip of fasteners and the bushing is movable from a position in which a fastener is located within the bore to a second position in which the strip is clamped against the trackway as the fastener is extracted therefrom. A carriage assembly is positioned in the end of the barrel and includes guide fingers extending into the bore of the barrel. The carriage is movable from a first position in which the fingers are rigidly held, from pivoting, against the wall of the barrel to a second position in which the fingers are free to pivot and permit the fastener to pass therethrough.

DESCRIPTION OF THE PREFERRED EMBODIMENTS

My barrel assembly, generally designated 10, is adapted for attachment to a standard driving tool (not shown) of the type used to drive fasteners into workpieces. These fasteners are generally of the type carried within a plastic strip having side rails, and the strip may or may not provide a washer for the final fastener assembly. The fasteners may be nails, screws or some other type which can be set by the torquing or impacting of a driver integrally connected to the driver tool.

Figure 1:
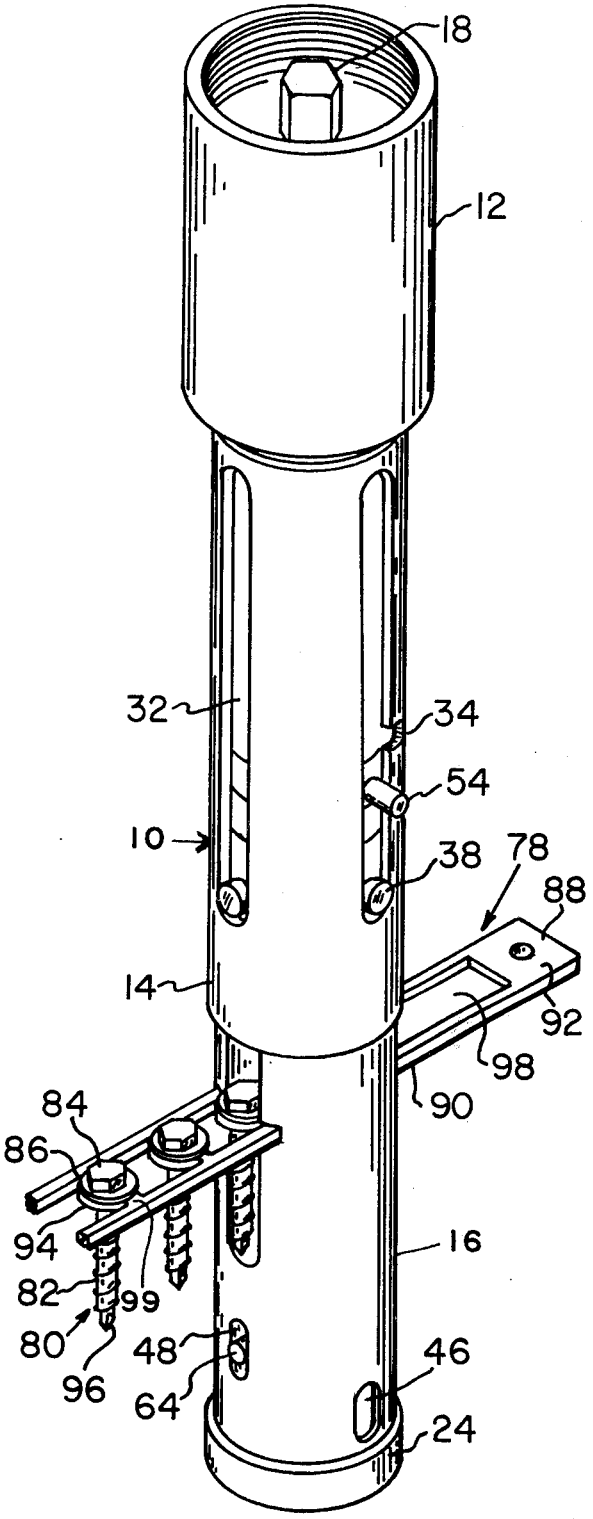
FIG. 1 is an isometric of my barrel assembly.
Figure 2:
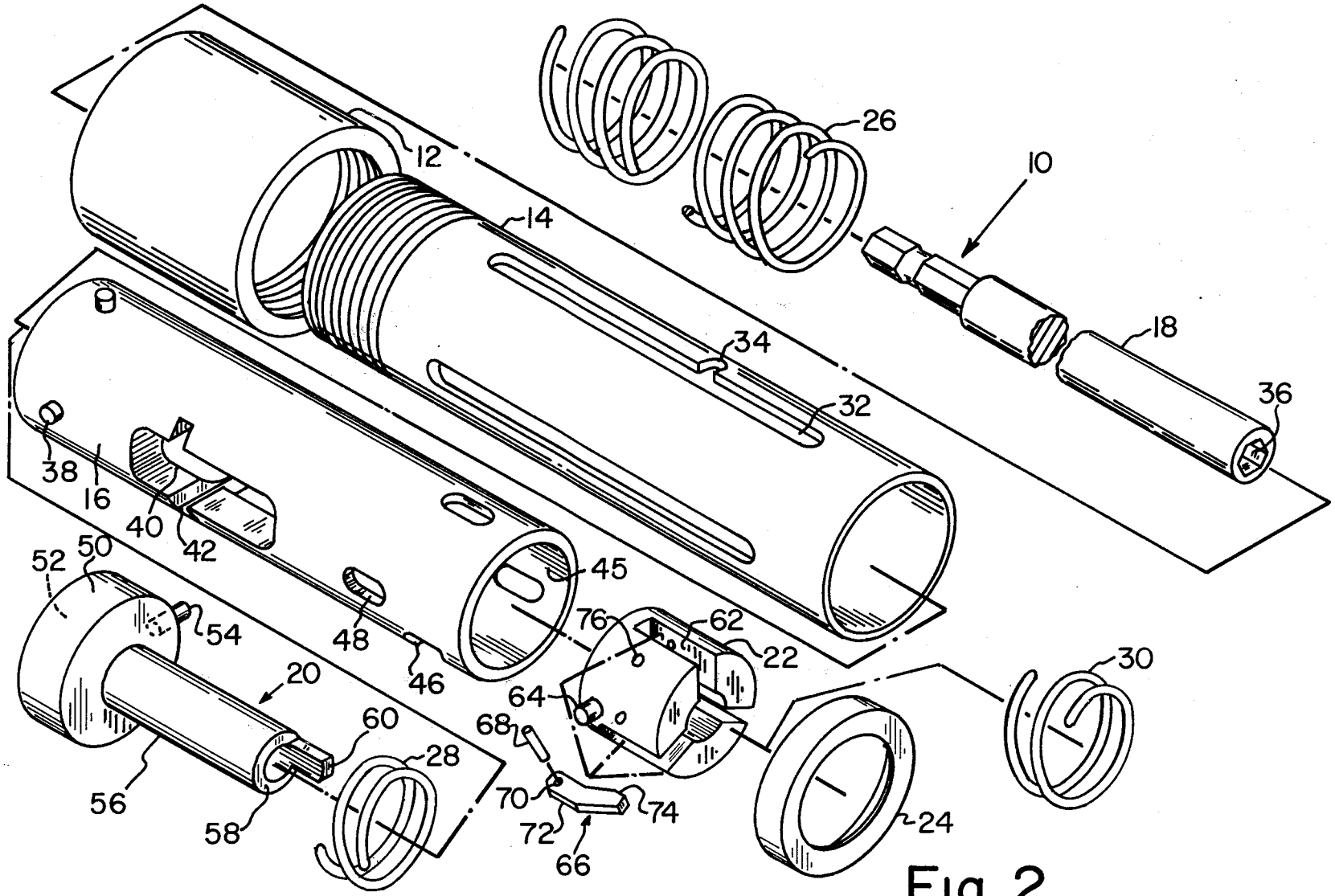
FIG. 2 is an exploded view of my barrel assembly showing the various components thereof.

The various components of my barrel assembly 10 can thus be seen in FIGS. 1 and 2. An internally threaded coupling 12 connects at one end to the driver (not shown) and at the other end to externally threaded sleeve 14. Sleeve 14 includes a plurality (three) of parallel and equally spaced elongated slots 32 extending along its longitudinal axis. One such slot 32 includes a connecting transverse slot 34 which, along with the slot 32, forms a bayonet type connection for the bushing 20 as will be described hereinafter.

Figure 3:
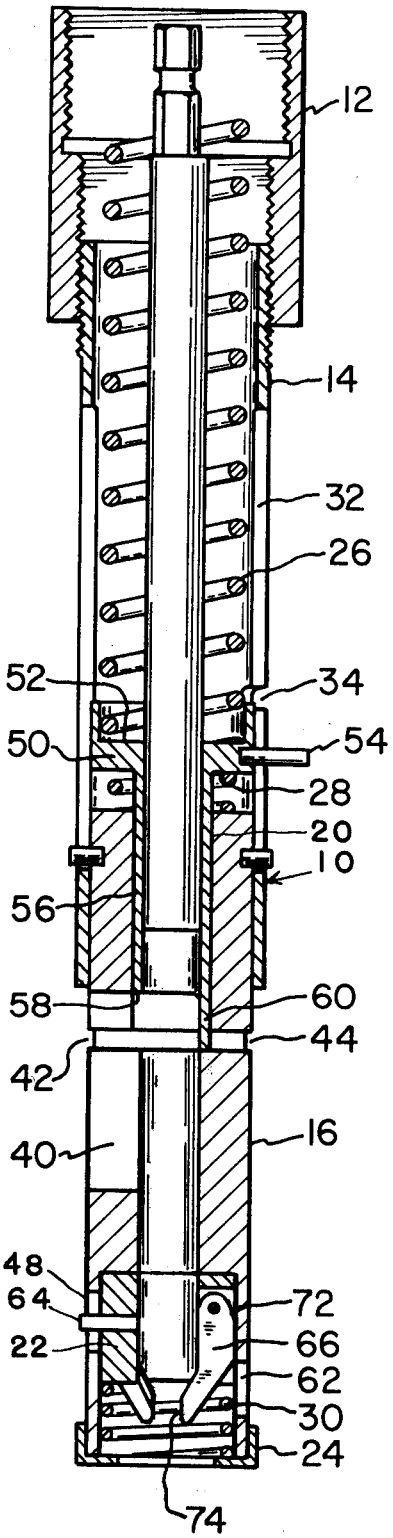
FIG. 3 is a section taken along the longitudinal axis of my barrel assembly.

Retractably operable within sleeve 14 is barrel 16 (FIGS. 1–3). Barrel 16 includes a plurality of lugs 38 which connect at right angles to barrel 16. Lugs 38 extend through the slots 32 of sleeve 14 to retain the barrel 16 within the sleeve 14 and to be slidable along slots 32 during the retraction of barrel 16 within sleeve 14. The barrel wall 45 of barrel 16 has extending therethrough an elongated fastener opening 40, an entry trackway 42 in registry with the fastener opening 40 and an exit trackway 44 which is in alignment with the entry trackway 42, FIGS. 3 and 4. Three relatively short, equally spaced and parallel elongated slots 46 extend through the barrel wall 45 adjacent the end thereof and carriage retention and alignment opening 48 also extend through the barrel wall 45 near the end thereof.

A bushing 20 is positioned within the sleeve 14, FIGS. 2 and 3. The bushing 20 includes an enlarged annular head section 50 having a recess 52 therein and an elongated, annular column 56 which extends into the barrel 16. A lift pin 54 is connected to and extends outwardly from the enlarged head 50 and rides in the slot 32 of sleeve 14 and forms the bayonet connection with the transverse slot 34. Annular column 56 terminates in a bottom edge 58 which extends about the majority of the circular cross section of column 56. A tang 60 formed by an extension of column 56 extends outward from the bottom edge 58 in the area of the circular cross section which does terminate as bottom edge 58.

Figure 5:
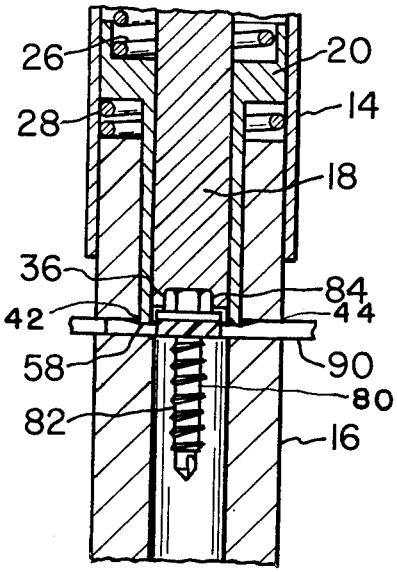
FIG. 5 is an enlarged section of the bushing in FIG. 4 in a strip engaging position.

A coil spring 26 is positioned at one end within the recess 52 formed in the enlarged head 50 of bushing 20 and is biased against the driving tool (not shown) at the other end, FIGS. 2 and 3. A second, much shorter coil spring 28 is positioned adjacent the bottom of enlarged head 50 of bushing 20 and against the top of barrel 16. Coil spring 26 functions to maintain barrel 16 in an extended position. In a similar manner, coil spring 28 functions to maintain bushing 20 in an extended position relative to barrel 16. The relative biasing strengths of the springs are important. In the fully extended and relaxed position the short coil spring 28 must be of sufficient strength to overcome the preload of the larger spring 26 so as to space bushing head 50 from barrel 16, FIG. 3. In the driving position the larger spring 26 must be of sufficient strength to overcome the preload of short spring 28 so as to provide the clamping function of the bushing 20 to be described hereinafter, FIG. 5.

In the relaxed or extended position the bushing bottom edge 58 is spaced slightly above or rearward of the entrance and exit trackways 42 and 44, respectively, and the tang 60 extends into the line of travel formed by the respective trackways. Lift pin 54 permits hand movement of the bushing 20 so that the tang 60 can be moved completely out of the line of the exit and entry trackways and the lift pin 54 can be further moved into the transverse slot 34 so as to lock the bushing 20 out of line with the entrance and exit trackways 42 and 44, respectively to permit loading of the strip 78, FIG. 1.

Figure 7:
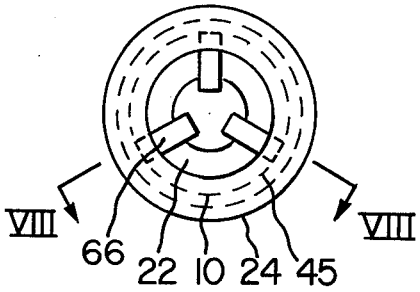
FIG. 7 is a bottom view showing the carriage assembly.
Figure 8:
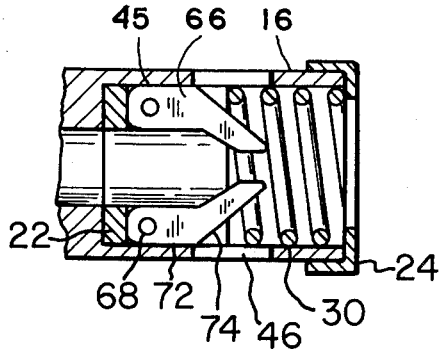
FIG. 8 is a section taken along lines VIII—VIII of FIG. 7.

Carriage 22 is positioned within the free end of barrel 16, FIGS. 2 and 3. Carriage 22 includes three equally spaced and parallel slots 62 extending longitudinally from the one end of carriage 22 throughout most of the axial extent thereof. Slots 62 are spaced so as to be in alignment with slots 46 of barrel 16 and this alignment is maintained by a pin 64 which connects to and extends outwardly from carriage 22 through single, elongated opening 48 in the barrel wall 45. Pin 64 also retains carriage 22 within the barrel 16. Three individual fingers 66 are respectively pivotally connected within the slots 62, FIGS. 2 and 7. This pivotal connection is made as follows. Holes 76 extend through opposing sides of slot 62 in the carriage 22 and a pivot pin 68 extends through the slot 76 and through a hole 70 in finger 66, FIG. 2. The finger 66 includes an abuttment portion 72 adapted to abut and slide along the wall 45 of barrel 16. A distal portion 74 extends angularly outward from the abuttment portion 72 of each finger 66 and into the central bore of the annular carriage 22, FIG. 8.

An end ring 24 is threadably mounted to the end of barrel 16 and a coil spring 30 is positioned between annular ring 24 and the carriage 22. Spring 30 functions to maintain carriage 22 in an extended position away from the end of the barrel 16 so that the abuttment portion 72 of each finger 66 is rigidly positioned against the wall 45 of the barrel 16 so as to prevent rotation of the fingers 66, FIGS. 3 and 8.

The invention is illustrated to accommodate a plurality of fasteners 80 maintained on a strip assembly 78, which is generally plastic, FIG. 1. The strip assembly 78 is made up of a strip 88 including side rails 90 having plastic washers 94 axially spaced and held therebetween by webs 99. Strip 88 terminates at its leading end in a tab 92 which facilitates loading. The fasteners 80 are illustrated as having a hex fastener head 84 terminating in a metal washer 86 adjacent the plastic washer 94. Extending through the washer 94 is shank 82 terminating in a drill point 96.

Figure 4:
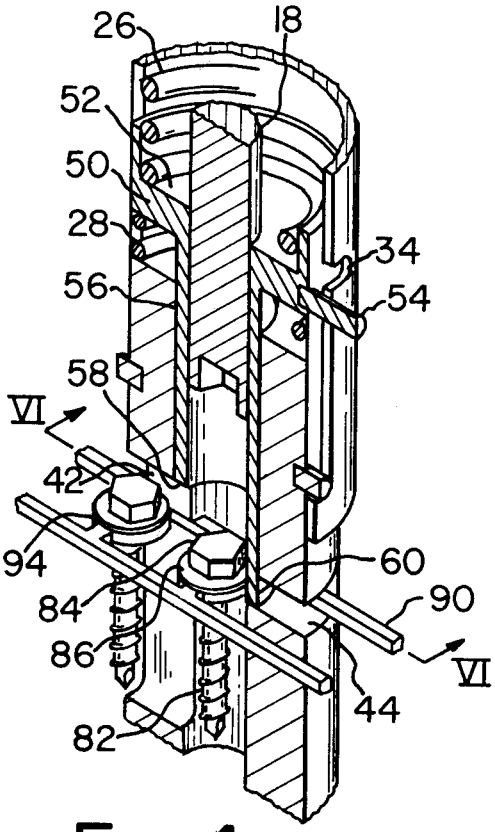
FIG. 4 is an enlarged view, partly in section, through a portion of the assembly showing the bushing in its relaxed position.

The loading of the fastener strip assembly 78 is best illustrated in FIGS. 1 and 4. The bushing 20 is hand lifted and locked through pin 54 into transverse slot 34 so that the tang 60 is out of line with the entry and exit trackways 42 and 44, respectively. The strip 78 is then fed through the entry trackway 42 and out of the exit trackway 44. An initial, elongated space 98 is provided between the first washer 94 and the tab 92. When this initial space 98 is roughly in line with the bushing 20, the bushing is hand moved out of transverse slot 34 and the spring 26 causes the tang 60 to drop into space 98. The tab 92 is then gripped and pulled forward by hand until the first fastener 80 is arrested by its engagement with tang 60. Since fasteners 80 of the type illustrated have a hex head 84, the tang 60 is dimensioned so as to engage the round metal washer portion 86 or plastic washer 94. This assures that each fastener 80 will be engaged in the same position, since engaging the hex head 84 could result in different positions depending on the orientation of the hex head. The tang 60 not only stops the fastener 80 but tang 60 locates the fastener 80 with respect to the bore of the barrel 16, FIG. 4.

The barrel assembly 10 is then positioned against the workpiece (not shown) and the driving tool is pushed forward thereagainst. The barrel 16 is forceably retracted into sleeve 14 and at the same time the bushing edge 58 is forced against the rails 90 of the strip assembly 78 so as to rigidly hold and clamp the rails 90 against the bottom surfaces of the entry and exit trackways 42 and 44, respectively, FIG. 5. In this position the strip is locked in place with the fastener 80 in proper alignment for setting. The socket 36 of the driver 18 engages the head 84 of the fastener 80 and continued advancement disengages the fastener and washer 94 from the webs 99 and rails 90. The fastener 80 is then driven down the bore of the barrel 16 where it is aligned and held by the three fingers 66 and, more particularly, the distal portion 74 which forms an internal bore.

Figure 6:
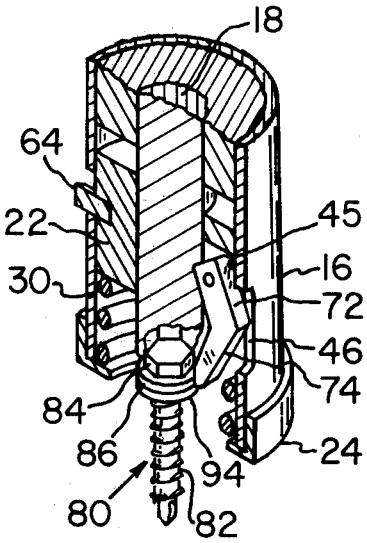
FIG. 6 is an enlarged view, partly in section, showing the carriage assembly in its extended position.

Further continued forward movement of the driving tool causes the fastener 80 and more particularly the plastic washer 94 to push against the fingers 66 and to cause the carriage 22 to move forward contracting the spring 30 when the preload of spring 30 is overcome. During this movement the fingers 66 cannot pivot since abuttment portion 72 is in intimate contact with wall 45. As the carriage 22 continues to move forward along the wall 45 of barrel 16, the abuttment portion 72 of the fingers 66 comes into registry with the slots 46 through the barrel wall 45, FIG. 6. When this occurs the fingers 66 are free to pivot about pivot pins 68 thereby permitting the fastener 80 and plastic washer 94 to pass through the fingers 66 and into final driven position into the workpiece.

It should be noted that the carriage 22 can be employed with any barrel in which a fastener is being driven and it is not limited to the particular barrel assembly 10 illustrated herein. Carriage 22 is particularly useful with self-drilling and tapping screws where the initial torquing of the fastener meets substantial resistance as the hole is being drilled in a metal workpiece. It is during this initial period that the fastener has a substantial tendency to skid or walk along the workpiece surface and it is for this reason that the fastener must be rigidly held at this stage of the setting operation. Once the tapping threads engage the hole, the fastener need not be so rigidly held and the torquing requirements are less for the final setting operation.

I claim:

1. An assembly for attachment to a driving tool having a driver for setting fasteners carried by a strip comprising:

A. a sleeve adapted for attachment to the driving tool;

B. a barrel retractably mounted to the sleeve for retraction therein and having a bore and aligned entry and exit trackways through a wall thereof and into the bore to accommodate the strip;

C. a movable bushing having a strip engaging end and positioned within the sleeve with said end extending into the barrel bore for slidable engagement therewith; and D. means associating with the bushing to urge said bushing between a first position wherein said bushing end is out of engagement with the strip and a second position wherein the bushing end clamps the strip against the trackways to permit the driver to extract the fastener in a setting stroke.

2. The assembly of claim 1, said sleeve including a plurality of spaced, longitudinal slots and said barrel including a plurality of pins extending outward therefrom through said slots to guide said barrel during retraction in the sleeve.

3. The assembly of claim 1, said bushing having a tang extending from the strip engaging end, said tang being in a line of travel of the strip to position the fastener in the barrel bore during said first position.

4. The bushing of claim 2 including means for displacing said bushing from the line of travel so as to permit loading of the strip through the barrel.

5. The assembly of claim 1, wherein said urging means includes a first spring positioned between the bushing and the driving tool and a second spring positioned between said bushing and said barrel.

6. The urging means of claim 5 wherein the respective resiliency of said springs permits the second spring to overcome a preload of said first spring in said first position when the barrel is in an extended position and the first spring overcomes the preload of said second spring in said second position to provide said clamp.

7. The assembly of claim 1 including a carriage assembly slidably positioned within the barrel at substantially the end thereof, said carriage assembly movable from a primary position wherein said carriage assembly defines an inner bore to guide said fastener and a secondary position wherein said carriage assembly permits passage of said fastener therethrough.

8. The carriage assembly of claim 7 including an annular carriage having a plurality of longitudinal slots in line with elongated slots in the barrel wall and fingers pivotally mounted in said longitudinal slots, said fingers having a first portion extending into the bore to define said inner bore and a second portion abutting against the barrel wall to prevent pivoting in the primary position, said longitudinal slots moving into registry with the elongated slots in the barrel in the secondary position to permit rotation of the fingers.

9. The carriage assembly of claim 8 including spring means positioned between the carriage assembly and the barrel end to urge the carriage assembly into the primary position in a relaxed condition.

10. A barrel assembly for attachment to a driving tool having a driver for setting fasteners carried by a strip comprising:

A. a sleeve adapted for attachment to the driving tool;

B. a barrel retractably mounted to the sleeve for retraction therein, said barrel having a bore, an exit end, spaced openings therethrough near the exit end and aligned entry and exit trackways extending through the barrel and into the bore to accommodate the strip;

C. a movable bushing having a strip engaging end and positioned within the sleeve, said end extending into the barrel bore for slidable engagement therewith;

D. first spring means biased between the bushing and the driver to urge the bushing and barrel into an extended position;

E. second spring means biased between the bushing and the barrel, said bushing movable between a first position wherein said bushing end is out of engagement with the strip and a second position wherein the bushing end clamps the strip against the trackways to permit the driver to extract the fastener therefrom in a setting stroke;

F. an annular carriage slidably positioned within the barrel bore near the exit end thereof and having spaced and parallel slots therethrough;

G. guide fingers pivotally mounted within the slots of the carriage and extending into the bore to position and hold a fastener in the bore in guiding relationship; and H. biasing means associated with said carriage to urge the carriage away from the exit end, said carriage movable from a primary position wherein the fingers are rigidly held from pivoting by engagement with the barrel and a secondary position wherein the fingers are in alignment with the spaced openings to permit pivoting of the fingers and passage of the fastener therethrough.

11. The barrel assembly of claim 10, said bushing having a tang extending therefrom in alignment with the exit trackway so that in the first position the tang engages a fastener to position it within the barrel bore for setting.

12. The bushing of claim 10 wherein a pin extends from the bushing through a bayonet slot in the barrel so that the bushing tang can be positioned out of line with the exit trackway to permit threading of the strip.

* * * * *